US005282701A

United States Patent [19]

An et al.

[11] Patent Number: 5,282,701

[45] Date of Patent: Feb. 1, 1994

[54] METHOD AND APPARATUS FOR A LOADING TEST OF A PILE USING A SELF-REPULSIVE FORCE

[75] Inventors: Kyung-Han An; Myung-Whan Lee; Dae-Young Kim; Bon-Hyoung Koo; Sung-Jin Yoon, all of Seoul, Rep. of Korea

[73] Assignee: Samsung Construction Co., Ltd., Seoul, Rep. of Korea

[21] Appl. No.: 849,873

[22] Filed: Mar. 12, 1992

Related U.S. Application Data

[63] Continuation-in-part of Ser. No. 618,647, Nov. 27, 1990, abandoned.

[30] Foreign Application Priority Data

Jul. 10, 1990 [KR] Rep. of Korea ..... 90-10418
Jul. 10, 1990 [KR] Rep. of Korea ..... 90-10419
Sep. 19, 1990 [KR] Rep. of Korea ..... 90-14842

[51] Int. Cl.[5] ..... E02D 7/30

[52] U.S. Cl. ..... 405/245; 405/253; 405/231; 405/232

[58] Field of Search ..... 405/231, 232, 243, 245, 405/247, 246, 250, 253, 254

[56] References Cited

U.S. PATENT DOCUMENTS 2,972,871 2/1961 Foley, Jr. .
3,324,666 6/1967 Lee .
3,327,483 6/1967 Gibbons .
4,295,759 10/1981 Mathieu et al. ..... 405/243
4,392,376 7/1983 Lagus et al. ..... 166/250 X
4,436,452 3/1984 Bodine .
4,591,466 5/1986 Murray et al. .
4,627,769 12/1986 Lee .
4,765,777 8/1988 Gregory .
4,844,661 7/1989 Martin et al. ..... 405/232
4,977,965 12/1990 Rupe ..... 405/232 X
4,992,002 2/1991 DeWitt .

OTHER PUBLICATIONS

"New Device for Load Testing Driven Piles and Drilled Shafts Separates Friction and End Bearing," *Piling and Deep Foundations,* vol. 1, 1989, pp. 421–427.
"A New Method of Static Pile Load Test System VUI-S-P," *Deep Foundations on Bored and Auger Piles,* 1988, pp. 291–302.

*Primary Examiner*—Dennis L. Taylor
*Assistant Examiner*—J. Russell McBee
*Attorney, Agent, or Firm*—Majestic, Parsons, Siebert & Hsue

[57] ABSTRACT

The present invention relates to a method and an apparatus for a loading test of a pile using a self-repulsive force. The loading test is separately performed in two stages, a first stage to estimate the ultimate peripheral skin friction force and a second stage to estimate the ultimate tip end bearing capacity. The loading test apparatus of the present invention has simple construction capable of reusing, which results in carrying out the loading test with ease and in cost effective manner.

16 Claims, 4 Drawing Sheets

METHOD AND APPARATUS FOR A LOADING TEST OF A PILE USING A SELF-REPULSIVE FORCE

This application is a continuation-in-part of Ser. No. 07/618,647, filed Nov. 27, 1990, now abandoned.

BACKGROUND OF THE INVENTION

1. Field of the Invention

The present invention relates to a method and an apparatus for a loading test of a pile using a self-repulsive force, i.e. the peripheral skin friction between the pile wall and the surrounding ground as the force required to cause the pile tip settlement, and more particularly to a method and an apparatus to carry out the loading test in which both a peripheral skin friction resistance and a tip end bearing capacity can be determined with ease and in a cost-effective manner.

2. Description of the Prior Arts

In general, there have been known three types of loading test methods, one type is to apply the load directly to a test pile, another type is to apply a load box or a load frame onto a test pile by means of a hydraulic jack, and a third type is to utilize a peripheral skin friction of the neighboring piles as the load causing the test pile settlement.

FIG. 1 illustrates a first method that a load is applied directly to a test pile 11. As shown in FIG. 1, a load box 12 is laid on an upper end of a test pile 11 filled with soil, sand, cement, wire, or given material. Balks 13 and I-shaped beams 14 are laid down sequentially under the load box 12, and then a loading test is carried out.

Referring to FIG. 2, a second method is carried out in such a manner that a load box or a load frame 22 supported by balks 23*a* and 23*b* is laid on a test pile 21, and I-beams 24 are disposed between the balks 23*a* and 23*b*. A test load more than expected maximum design load is applied to the load box 22. And then, a hydraulic jack 25 provided with a pressure gauge (not shown) is inserted between an upper end of the test pile 21 and the load box 22 to apply a load to the test pile 21 during a loading test.

Referring to FIG. 3, a third method for a loading test is carried out in such a manner that two reaction piles 33*a* and 33*b* or more are driven into the ground with a prescribed depth from the test pile 31. A reaction beam 34 having a stength enough to endure the axial force and the bending moment during the loading test is fixedly mounted on the upper ends of the reaction piles 33*a* and 33*b*. And then, a hydraulic jack 35 provided with a pressure gauge (not shown) is inserted between the upper end of the test pile 31 and the lower surface of the reaction beam 34 to apply a test load to the test pile 31 during the loading test.

However, in such conventional loading test methods, there have been raised some problems that it is difficult to use such methods because numerous structural components are required for the loading test and further they should be assembled one by one. Also, it needs prescribed time for curing the concrete in case that a concrete pile is used as a test pile. Furthermore, according to the conventional methods as mentioned above, only the combined forces i.e., summation of tip end bearing capacity and peripheral skin friction force can be measured. According to the known behavior of a pile, the majority of the applied load is supported by the peripheral skin friction force at the early stage of loading test, whereby it is impossible to apply the concept of the safety factor based on the actual load transferring mechanism of the pile in the conventional methods.

SUMMARY OF THE INVENTION

It is an object of the present invention to provide a method and an apparatus for a loading test of a pile using a self-repulsive force which can eliminate the problems encountered in the conventional loading test.

It is another object of the present invention to provide a method which is capable of accurately measuring a skin friction force and a tip end bearing capacity of a test pile with a cost effective manner.

It is still another object of the present invention to provide an apparatus for a loading test of a pile using a self-repulsive force which enables to eliminate most of the structural components required for the conventional loading test by constructing a test apparatus with a simple structure suitable to reuse.

With these objects in view, the apparatus for a loading test of a pile in accordance with the present invention comprises a hollow test pile; a cone-shaped end member abutted to the lower end of the test pile, having a separable pile shoe and a sliding core which is designed to be slided within a prescribed distance relative to the separable pile shoe; an end member driving means including a load transferring pipe, a hydraulic jack installed on the upper end of the load transferring pipe for exerting a driving force thereon, and a reaction plate assembled with the test pile by means of a plurality of tie bars; a sliding core driving means for depressing the sliding core into the ground; and measuring means for indicating displacements of both the test pile and the end member and oil presure supplied to the hydraulic jack, respectively.

In the meantime, the method for a loading test of a pile in accordance with the present invention comprises steps of driving a test pile assembly with a cone shaped end member into the ground with a prescribed depth; inserting a load transferring pipe into the test pile and assembling a hydraulic jack and measuring means to the test pile; driving the end member into the ground by means of the hydraulic jack until the measuring means show the sudden changes of indicator; partially disassembling the test pile assembly and inserting a T-shaped load transferring member upon the sliding core and then re-assembling the test pile assembly; and driving the sliding core into the ground by means of the hydraulic jack through the T-shaped load transferring member until the measuring means show the sudden changes of indicator.

Other features and object of the present invention will become apparent from the following description of the preferred embodiment taken in conjunction with the accompanying drawings.

DETAILED DESCRIPTION OF THE PREFERRED EMBODIMENTS

Figure 1:
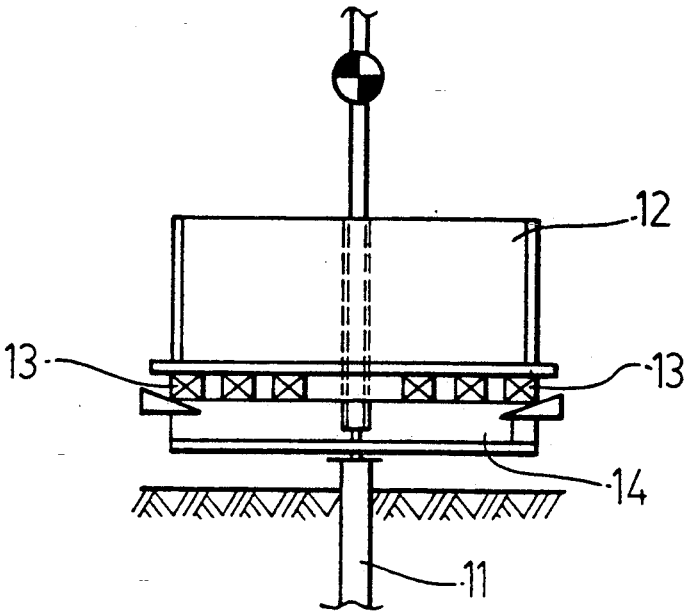
Prior Art FIG. 1.
FIG. 1 is an explanatory view illustrating a conventional loading test method for applying a load to a test pile.
Figure 2:
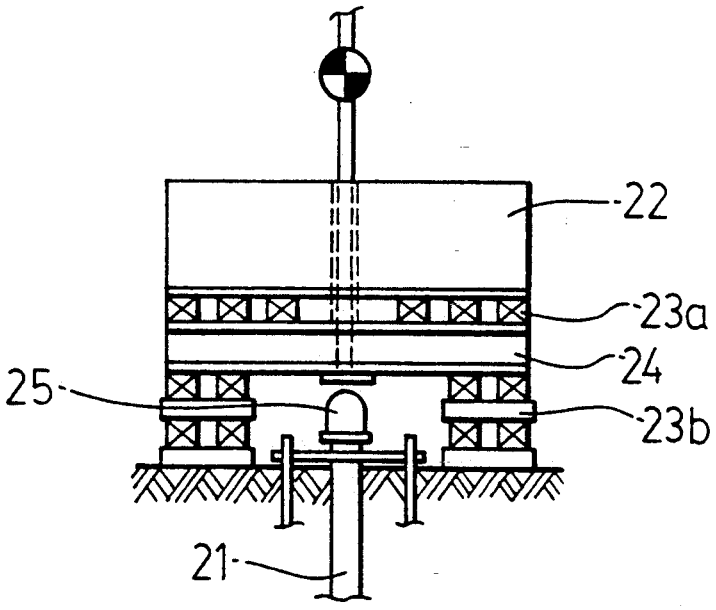
Prior Art FIG. 2.
FIG. 2 is an explanatory view illustrating another conventional loading test method for applying a load to a test pile.
Figure 3:
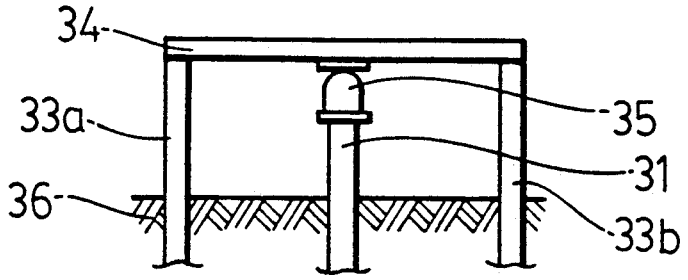
Prior Art FIG. 3.
FIG. 3 is an explanatory view illustrating still another conventional loading test method for applying a load to a test pile.
Figure 4:
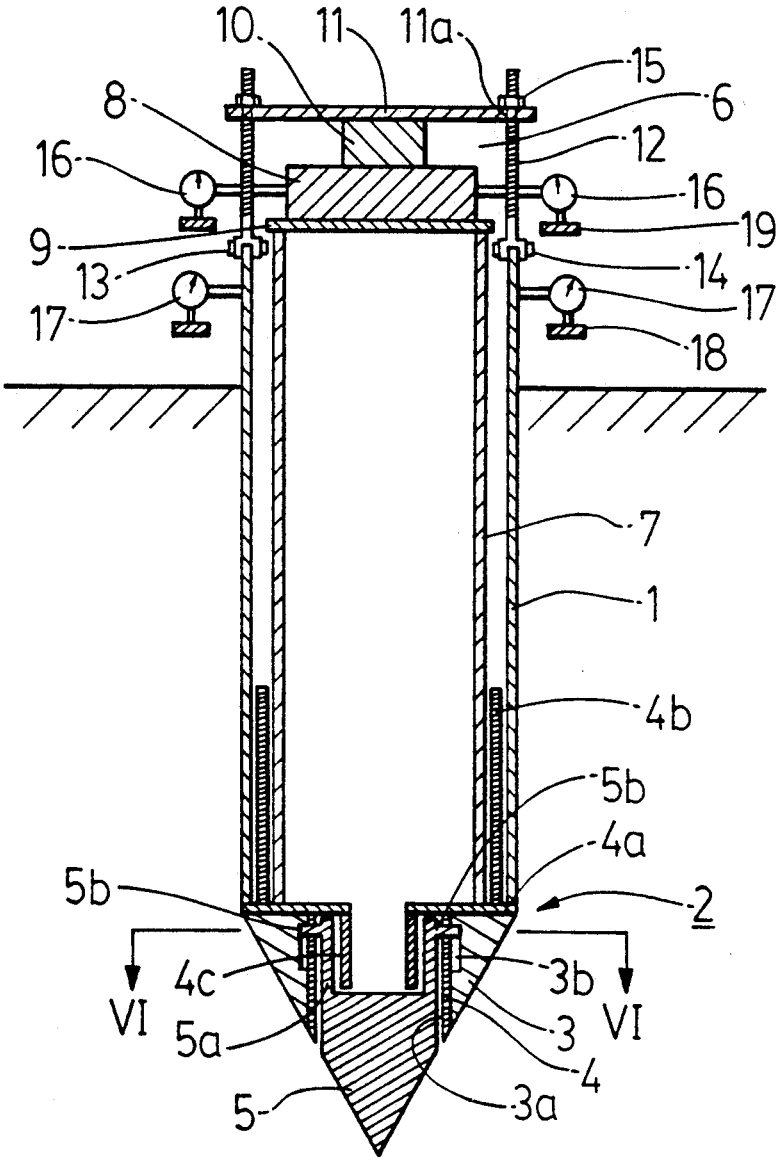
FIG. 4 is a sectional view illustrating a first stage of a loading test method in accordance with the present invention.
Figure 6:
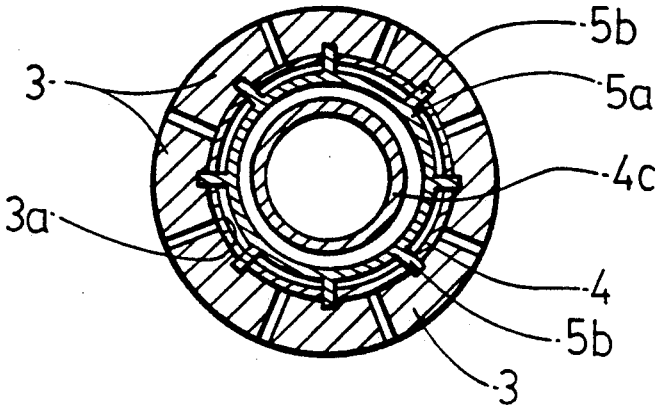
FIG. 6 is a cross sectional view along the line VI—VI in FIG. 4.

Referring to FIG. 4 and FIG. 6, there is shown a test pile assembly of the present invention of which an upper portion is protruded from the ground with a prescribed height. The test pile assembly comprises a hollow steel pipe 1, of which diameter can be selected according to the test pile design. At the lower end of the test pile 1, a cone-shaped end member 2 is detachably assembled.

The end member 2 comprises a separable pile shoe 3 having a triangular cross-section. The separable pile shoe 3 is integrally welded to an inner pipe 4 which is welded to a lower surface of a ring-shaped lower ring portion 4*a* to leave a throughhole 3*a* therein. On the upper surface of the lower ring portion 4*a* an upper ring portion 4*b* having a thin wall and smaller diameter than that of the test pile 1 is welded thereto. Each separable pile shoe 3 has a guide groove 3*b* at its internal surface 3*a* for restricting the up/down movement of the sliding core 5.

The sliding core 5 formed with cone-shaped end is provided with a cylindrical wall portion 5*a* having stoppers 5*b* at the upper end thereof. The wall portion 5*a* is inserted between the inner pipe 4 and a guide pipe 4*c* which is welded to the lower surface of the lower ring portion 4*b*. When the sliding core 5 is slidably moved upward or downward according to the loading test, the stoppers 5*b* are slidably guided within the corresponding guide grooves 3*b* of the separable pile shoe 3 so as to restrict the movement range of the sliding core 5.

The cross-sectional area of the sliding core 5 depends upon the ground condition, but usually its area is in the range between ¼ and 1/16 of that of the separable pile shoe 3.

Meanwhile, an end member driving means 6 comprises a load transferring pipe 7 having a prescribed diameter which is capable of being inserted within the lower ring portion 4*a*. A hydraulic jack 8 is installed on the upper end of the load transferring pipe 7 through a support plate 9 which is designed to support the hydraulic jack 8 and to uniformly deliver the driving force of the hydraulic jack 8 onto the load transferring pipe 7.

A load cell 10 is mounted on the hydraulic jack 8 in order to indicate the substantial load delivered to the load transferring pipe 7 by the jydraulic jack 8. A reaction plate 11 is laid upon the load cell 10. The reaction plate 11 is assembled with the test pile 1 through a pluralily of tie bars 12 (preferably six or twelve pieces) having a threaded portion on its periphery. The tie bars 12 are assembled with the test pile 1 by securing connection members 13 with bolts 14. The tie bars 12 are placed through the holes 11*a* in the reaction plate 11 and the reaction plate 11 is secured with nuts 15.

Here, the assembly status between the test pile 1 and the reaction plate 11 by means of the tie bars 12 can be adjusted by tightening the nuts 15 so that the top portion of the hydraulic jack 8 is in full contact with the reaction plate 11 according to the test condition.

As measuring means, a series of dial gauges 16 are attached at the side surface of the hydraulic jack 8 and another series of dial gauges 17 are attached to the upper portion of the test pile 1 for indicating their displacement relative to the reference beams 18 and 19 respectively.

A pressure gauge (not shown) is attached to the hydraulic pump (not shown) for indicating the oil pressure delivered to the hydraulic jack 8.

Figure 5:
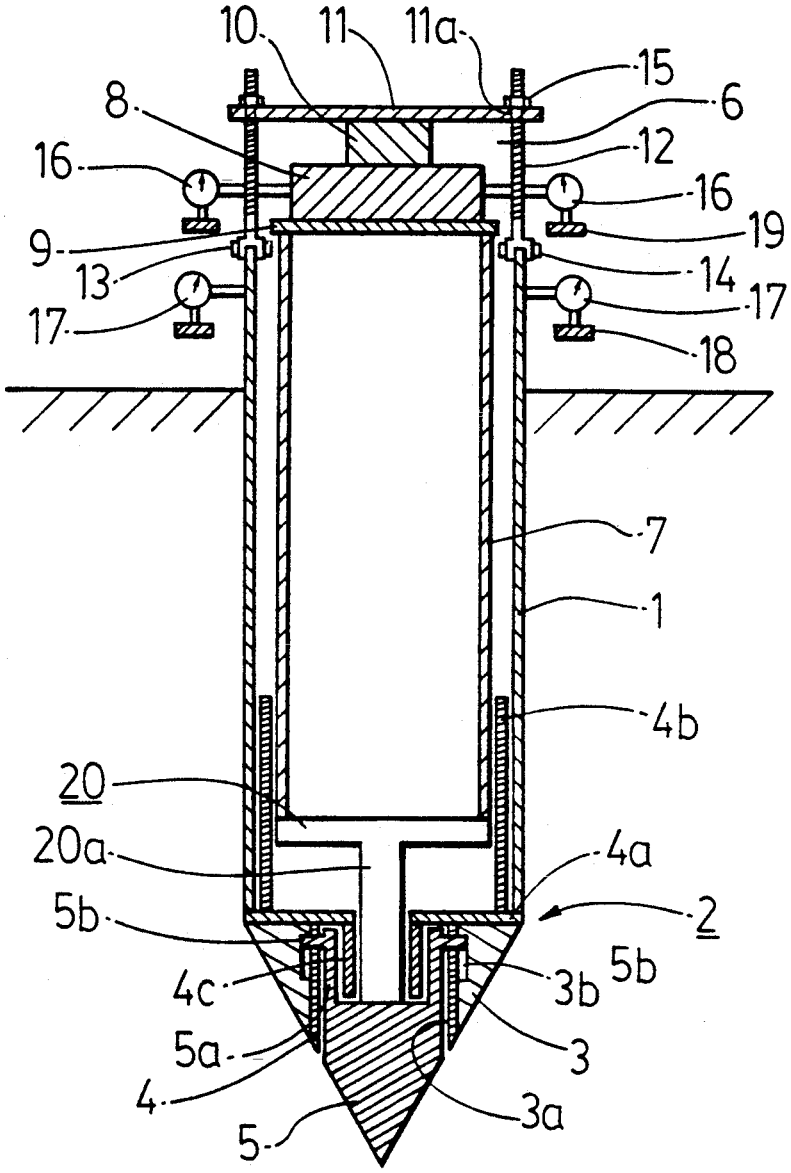
FIG. 5 is a sectional view illustrating a second stage of a loading test method in accordance with the present invention.

A T-shaped load transferring member 20 having a cylindrical portion 20*a*, as shown in FIG. 5, is also provided to deliver the driving force of the hydraulic jack 8 through the load transferring pipe 7 only to the sliding core 5 in the second stage of loading test in accordance with this invention.

Now, we will explain the method for a loading test of the test pile using a self-repulsive force in accordance with the present invention.

The test method of the present invention comprises a first stage for estimating the peripheral skin friction resistance of the test pile 1 and a second stage for estimating the tip end bearing capacity of the test pile 1 against the ground.

Firstly, the first stage of the loading test is performed as follows. With the test assembly constructed as shown in FIG. 4, the compressive load from the hydraulic jack 8 is delivered to the upper surface of the separable pile shoe 3 through the load transferring pipe 7. The end member 2 comprising the sliding core 5 and the separable pile shoe 3 begins to gradually penetrate into the ground, where the separable pile shoe 3 settles as the compressive load applied from the hydraulic jack 8 increases.

At the same time, the load by the hydraulic jack 8 is delivered to the test pile 1 as a tensile load via the tie bars 12 in which the test pile 1 is resisted by the peripheral skin friction force over its entire outer preiphery against the surrounding soil.

With the monitoring the measuring means, i.e. the dial gauges 16 and 17 and the pressure gauge, the hydraulic jack 8 continues to operate until the measuring means indicates skin peculiar changes in its indicator where the peripheral friction resistance reach a failure point. The failure point is defined where the amount of settlement continues to increase upon no increase of applied load.

The compressive load which causes a settlement of the separable pile shoe 3 is exactly the same as the tensile load applied to the test pile 1. Upon monitoring the measuring means, the displacements of the test pile 1 and the end member 2 with respect to the applied load from the hydraulic jack 8 can be plotted with a prescribed relationship. In other words, the load vs displacement behavior of both the peripheral skin friction and the tip end bearing capacity can be measured.

The purpose of performing the loading test is not only to obtain the load vs displacement relationship of the test pile 1 but also to determine the ultimate load carrying capacity of the test pile 1.

Since the compressive load resisted by the separable pile shoe 3 and the tensile load resisted by the pipe wall of the test pile 1 are exactly the same, it is not possible to determine the respective load in the first stage loading of the present invention. But usually the ultimate tip end bearing capacity is greater than the ultimate peripheral skin friction force, the skin friction failure occurs prior to the tip end bearing capacity failure. Therefore, it is possible to determine the ultimate peripheral skin friction force of the test pile 1 in the loading test of first stage in the present invention.

It is well known that the ultimate tip end bearing capacity is greater than the ultimate peripheral skin friction force in end bearing pile design. Hence, the ultimate peripheral skin friction failure is determined by monitoring both the dial gaues 17 and the pressure gauge when their indicating values are suddenly changed.

When the measurement of the peripheral skin friction failure is carried out as described above, next, the second stage of the loading test for estimating the tip end bearing capacity is performed as below.

Firstly, the end member driving means 6 is disassembled from the test pile 1, and the T-shaped load transferring member 20 is inserted within the inner wall portion 5*a* of the sliding core 5 and the load transferring pipe 7 is laid on the T-shaped load transferring member 20. Re-assembling the test assembly as described in the first stage of the loading test of this invention, the test assembly will be constructed as shown in FIG. 5. Since the cylindrical portion 20*a* of the load transferring member 20 is received within the inner wall portion 5*a* of the sliding core 5, the driving force from the hydraulic jack 8 through the load transferring pipe 7 is applied only to the sliding core 5:

While the resisting peripheral skin friction remains the same, the tip end bearing capacity failure occurs prior to reaching the ultimate peripheral skin friction. Upon the monitoring the measuring means i.e., the dial gauges 16 and pressure gauge (not shown), it is assumed that sudden changes of the indications of the measuring means shows the tip end bearing capacity failure.

Therefore, the ultimate tip end bearing capacity can be measured as above the second stage of the loading test is finished.

Figure 7:
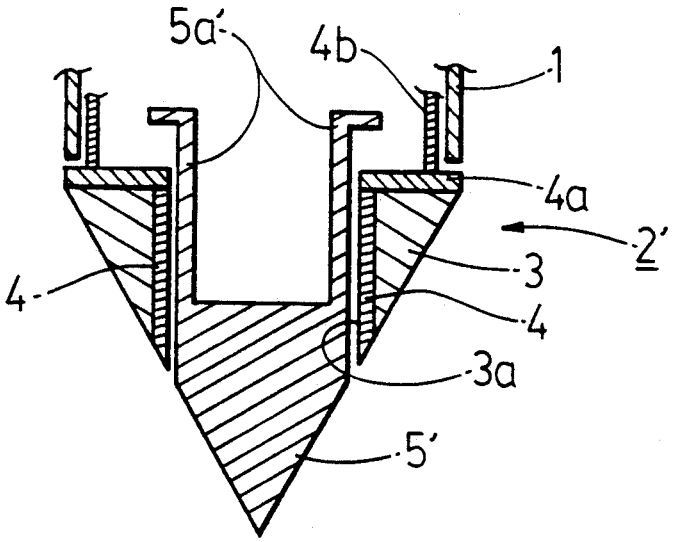
FIG. 7 is a partial sectional view of an end member having a sliding core in accordance with another embodiment of the present invention.

FIG. 7. shows another embodiment of an end member 2' in accordance with the present invention. The end member 2' has nearly the same construction except a sliding core 5' provided with a flanged wall portion 5*a'* on the upper surface thereof. Since operation of the sliding core 5' is the same as that of the sliding core 5, its detailed description will be omitted.

As described above, it is noted that the method and the apparatus in accordance with the present invention can carry out the loading test with ease and in a cost effective manner where the peripheral skin friction force or the tip end bearing capacity can be exactly measured with simple operation in short time.

What is claimed is:

1. A method for a loading test of a pile using a self-repulsive force comprising:

driving a test pile with an end member into the ground a prescribed depth;

inserting a load transferring pipe into said test pile and assembling a hydraulic jack and measuring means to said test pile;

pushing said end member with said load transferring pipe by means of said hydraulic jack until said measuring means show sudden changes of indicators;

removing said load transferring pipe, hydraulic jack, and measuring means from said test pile and inserting a load transferring element into said test pile, and then re-assembling said hydraulic jack and measuring means to said test pile; and pushing a sliding core of said end member with said load transferring element by means of said hydraulic jack until said measuring means show the sudden changes of indicators.

2. An apparatus for loading test of a pile using a self-repulsive force comprising:

a hollow test pile;

a cone-shaped end member abutted to the lower end of said test pile, said end member adapted to move with respect to said test pile, said end member comprising a pile shope attached to an inner pipe and a sliding core inserted in said inner pipe, said sliding core is designed to be slid a given distance relative to said inner pipe;

a driving means including a load transferring element, a hydraulic jack on the upper end of said load transferring element for exerting a driving force on said load transferring element, and a reaction plate assembled with said test pile; and measuring means for indicating displacement of both said test pile and said load transferring element and for indicating the oil pressure supplied to the hydraulic jack.

3. An apparatus for a loading test of a pile in accordance with claim 2, wherein the cross-sectional area of said sliding core is in the range between ¼ and 1/16 of that of said pile shoe.

4. An apparatus for loading test of a pile in accordance with claim 2, wherein said sliding core is provided with a plurality of stoppers to be received within corresponding guide grooves formed in said inner pipe, said stoppers being adapted to slide within said guide grooves.

5. An apparatus for a loading test of a pile in accordance with claim 2, wherein said measuring means comprises a series of dial gauges attached at the side surface of said hydraulic jack, another series of dial gauges attached to the upper portion of said test pile, and a pressure gauge attached to the hydraulic pump.

6. An apparatus for a loading test of a pile in accordance with claim 2, wherein said sliding core is provided with a flanged wall portion on the upper surface thereof.

7. The method of claim 1 wherein said end member pushing step includes pushing on a pile shoe and said sliding core and wherein said sliding core pushing step includes pushing on said sliding core but not said pile shoe.

8. The method of claim 1 further comprising the step of providing said load transferring element by attaching a T-shaped load transferring member to an end of said load transferring pipe.

9. The apparatus of claim 2, wherein said load transferring element comprises a load transferring pipe which is adapted to contact the end member in a member that said driving means pushes on said end member.

10. The apparatus of claim 9, wherein said pile shoe is attached to a doughnut-shaped portion for contacting said load transferring pipe and wherein a cylindrical portion is attached to said doughnut-shaped portion, said cylindrical portion is adapted to be positioned between said load transferring pipe and said hollow test pile.

11. The apparatus of claim 2, wherein said load transferring element comprises a load transferring pipe connected to a T-shaped load transferring member, said T-shaped load transferring member is adapted to contact the sliding core in a manner that said driving means pushes on said sliding core.

12. The apparatus of claim 2, wherein said reaction plate is attached to the hollow test pile with tie bars.

13. An apparatus for use in a loading test of a pile using a self-repulsive force comprising:

a hollow test pile;

an end member abutted to the lower end of said test pile, said end member adapted to move with respect to said test pile, said end member comprising an outer member defining a hole and comprising a sliding core inside said hole, said sliding core adapted to slide relative to said outer member; and a sliding means including a load transferring element, a hydraulic jack for exerting a driving force on said load transferring element, and a reaction plate assembled with said test pile.

14. The apparatus of claim 13, further comprising measuring means for indicating displacement of both said test pile and said load transferring element and for indicating oil pressure supplied to the hydraulic jack, respectively.

15. The apparatus of claim 13, wherein said load transferring element comprises a load transferring pipe which is adapted to contact the end member in a manner that said driving means pushes on said end member.

16. The apparatus of claim 13, wherein said load transferring element comprises a load transferring pipe connected to a T-shaped load transferring member, said T-shaped load transferring member is adapted to contact the sliding core in a manner that said driving means pushes on said sliding core.

* * * * *

UNITED STATES PATENT AND TRADEMARK OFFICE

CERTIFICATE OF CORRECTION

PATENT NO. : 5,282,701

DATED : February 1, 1994

INVENTOR(S) : An et al.

It is certified that error appears in the above-indentified patent and that said Letters Patent is hereby corrected as shown below:

| | |
|---|---|
| Column 6, Line 14, in Claim 2: | Replace "shope" with --shoe-- |
| Column 6, Line 58-69, in Claim 9: | Replace "in a member that" with --in a manner that-- |
| Column 7, Line 17, in Claim 13: | Replace "a sliding means" with --a driving means-- |

Signed and Sealed this

Nineteenth Day of July, 1994

*Attest:*

Bruce Lehman

BRUCE LEHMAN

*Attesting Officer*

*Commissioner of Patents and Trademarks*